United States Patent [19]

Wernicke et al.

[11] 4,282,313

[45] Aug. 4, 1981

[54] PHOTOGRAPHIC MATERIAL WITH STABILIZERS

[75] Inventors: Ubbo Wernicke, Odenthal; Heinrich Odenwälder, Cologne; Friedhelm Sommer, Leverkusen, all of Fed. Rep. of Germany

[73] Assignee: Agfa-Gevaert Aktiengesellschaft, Leverkusen, Fed. Rep. of Germany

[21] Appl. No.: 971,445

[22] Filed: Dec. 20, 1978

[30] Foreign Application Priority Data

Dec. 29, 1977 [DE] Fed. Rep. of Germany ..... 2758720

[51] Int. Cl.[3] ..... G03C 7/00; G03C 1/06

[52] U.S. Cl. ..... 430/407; 430/372; 430/448; 430/446; 430/611; 430/613

[58] Field of Search ..... 96/59, 64, 95, 22, 55; 430/372, 446, 611, 448, 613, 407

[56] References Cited

U.S. PATENT DOCUMENTS

| | | | |
|---|---|---|---|
| 2,403,927 | 7/1946 | Kendall . | |
| 3,397,987 | 8/1968 | Luckey | 96/109 |
| 3,486,901 | 12/1969 | Karlson | 96/109 |
| 3,565,621 | 2/1971 | Tsuchida et al. | 96/61 |
| 3,600,178 | 8/1971 | Willems | 96/76 |
| 3,809,563 | 5/1974 | Nimura | 96/22 |
| 4,139,387 | 2/1979 | von König et al. | 96/107 |
| 4,184,875 | 1/1980 | Odenwälder | 430/407 |

FOREIGN PATENT DOCUMENTS 1067066 5/1967 United Kingdom .

OTHER PUBLICATIONS

Research Disclosure, May 1977, No. 15750.

*Primary Examiner*—Mary F. Downey
*Attorney, Agent, or Firm*—Connolly & Hutz

[57] ABSTRACT

Thiocarbohydrazide derivatives act as stabilizers when processing photographic materials in the conventional black and white developers of the type used as first developer in color reversal processes. Furthermore, they can promote the development of color in the second developer in color reversal processes in such a way that a second exposure or fogging baths may be dispensed.

4 Claims, No Drawings

PHOTOGRAPHIC MATERIAL WITH STABILIZERS

This invention relates to a photographic material comprising at least one silver halide emulsion layer which is improved by addition of a thiocarbohydrazide derivative. The invention also relates to a process for the production of photographic images in the presence of these derivatives.

It is known that light-sensitive silver halide emulsions tend to form fog, i.e. nuclei which may be developed without exposure. Such fog formation is increased during prolonged periods of development or during development at elevated temperatures. The fog formation is an interfering factor both with materials which are subjected to negative development and with materials which are subjected to reversal processing in the conventional baths. For example, fog nuclei cause the silver halide to be reduced in the unexposed areas during reversal processing in the first developer, so that too little silver halide is available during second development, with the result that the maximum densities obtained are too low.

It is known to add so-called anti-fog agents or stabilizers to photographic silver halide emulsions, in order to reduce the formation of fog. Heterocyclic mercapto compounds, for example those described in German Auslegesschrift No. 1,183,371, German Offenlegungsschrift No. 2,308,530 and German Offenlegungsschrift No. 1,622,271, have a stabilizing effect.

Inhibitors which are present as releasable groups of DIR compounds are also known from German Offenlegungsschrift No. 2,548,880.

Such inhibitors and stabilizers may, however, in reversal processing be concentrated at the residual silver halide during first development and restrict second development so that only reduced colour densities are obtained.

In order to prevent the formation of dyes from being hindered in this way, it is proposed in German Offenlegungsschrift No. 2,548,880 that the photographic material should be treated with certain chemical fog baths prior to second development. Such fog baths are however disadvantageous owing to their instability.

An object of the present invention is therefore to provide compounds for use in photographic materials comprising least one silver halide emulsion layer, which compounds reduce fog formation but avoid the disadvantages of known stabilizers and do not adversely affect second development during reversal processing. A further object is to provide a process for the production of photographic images by processing photographic materials in the presence of such compounds.

It has now been found that certain thiocarbohydrazide derivatives act as stabilizers when processing photographic materials in the conventional black-and white developers of the type used, for example, as first developer in colour reversal processes and which do not inhibit development during reversal processing in the conventional (colour) second developers but promote the development of colour in the second developer, if desired in such a way that second exposure of the conventional baths for chemical fogging may be dispensed with.

The present invention relates to a light-sensitive photographic material comprising at least one silver halide emulsion layer and at least one compound corresponding to the following formula I:

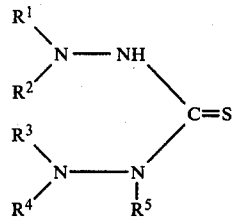

(I)

in which $R^1$ and $R^4$ which may be the same or different represent hydrogen, a saturated or olefinically unsaturated aliphatic group; an aryl group; a heterocyclic group or an acyl group;

$R^2$ and $R^3$, which may be the same or different, represent hydrogen, a saturated or olefinically unsaturated aliphatic group, an aryl group or a heterocyclic group and $R^5$ represents hydrogen; and/or $R^1$ together with $R^2$ and/or $R^3$ together with $R^4$ represent an alkylidene group, preferably a methylidene group, which may be substituted by alkyl, aryl, a heterocyclic group or acyl, in which two substituents of this type, together with the carbon atoms of the methylidene group, may complete a carbocyclic or heterocyclic ring, for example a cyclopentane, indane, indanone, indandione, piperidine, pyrrolidone or indolone ring. Examples of non-cyclic substituted methylidene groups are ethylidene; 3,3-dimethyl-2-butylidene; benzylidene and furfurylidene; and/or $R^1$ together with $R^4$ or $R^5$ represent the atoms required to complete a 5- or 6-membered heterocyclic ring, in particular a 1,2,3,4-tetrazolidine-5-thione ring; a hexahydro-1,2,4,5-tetrazine-3-thione ring; a hexahydro-1,2,4-triazine-3-thione ring or a 2,3,4,5-tetrahydro-1,2,4-triazine-3-thione ring; this is generally a methylene group which may be substituted once or twice, for example by alkyl, cycloalkyl, aralkyl or aryl; two such substitutents, for example, two alkyl radicals, may in turn form, together with the carbon atom of the methylene group, a ring, in particular a carbocyclic ring such as, for example, a cyclopentane, cyclohexane or 3,3,5-trimethyl cyclohexane ring.

Examples of saturated aliphatic groups are alkyl groups which may be straight or branched chain or cyclic, and contain up to 18 carbon atoms and may be further substituted, for example by carboxyl, carbamoyl or nitrile groups.

A suitable olefinically unsaturated aliphatic group is, for example, an allyl group, suitable heterocyclic groups are preferably 5- or 6-membered N-containing rings, particularly those indicated above.

Suitable aryl groups include, in particular, phenyl which may be substituted, for example by halogen, hydroxyl alkoxy, alkyl thio, carboxyl, sulphamoyl, amino and/or alkyl.

Suitable acyl radicals include those which are derived from aliphatic or aromatic carboxylic or sulphonic acids including (thio-) carbonic monoesters, carbamic acids or sulphamic acids. Examples of such acyl radicals are acetyl, benzoyl, phenyl sulphonyl, carbamoyl, phenyl carbamoyl, ethoxycarbonyl, ethoxythiocarbonyl.

The compounds corresponding to formula (I) may be provided with a radical which makes them resistant to diffusion, for example with a long-chained alkyl or alkylene group which may be bonded via a heteroatom.

Particularly suitable compounds corresponding to formula (I) are those in which at least one of the radicals $R^1$ and $R^4$ represents an acyl radical with $R^2$, $R^3$ and $R^5$ representing hydrogen, for example the following compounds:

(II)

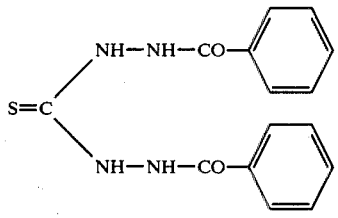

(III)

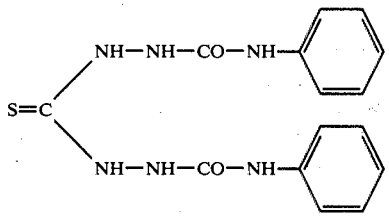

(IV)

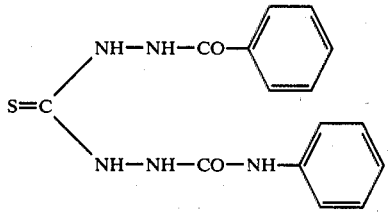

(V)

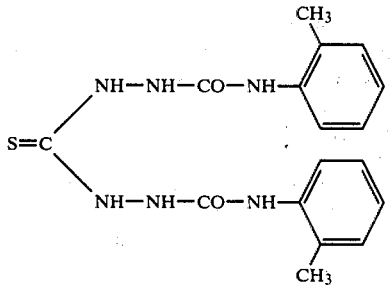

The compounds according to the invention may be obtained from thiocarbohydrazide by known methods of the type found, for example, in the literature in J. Indian Chem. Soc. 1, 141 and in J. Org. Chem. 34, 756.

PREPARATION OF COMPOUND II 116 ml of benzoyl chloride are added dropwise at a temperature of 25° C. to a suspension of 53 g of thiocarbohydrazide in 350 ml of pyridine with stirring and cooling. After addition, the mixture is stirred for a further 3 hours at room temperature and subsequently mixed with 6 liters of water. The precipitate obtained is separated, dissolved and reprecipitated from methanol/water and, after drying in air is mixed with 1.7 liters of boiling ethyl acetate and after cooling, is suction filtered and dried in the air. 112 g of 1,5-bisbenzoylthiocarbohydrazide which melts at 177° to 179° C. with decomposition are obtained.

The invention also relates to a process for the production of photographic images by processing photographic materials in the presence of the substances to be used in accordance with the invention.

The materials according to the invention may be processed by the conventional methods with the conventional developers. Suitable black-and-white developers include, for example, hydroquinone, p-methylaminophenol and 1-phenyl-3-pyrazolidone. Suitable colour developer substances include, for example, N,N-dimethyl-p-phenylenediamine;
4-amino-3-methyl-N-ethyl-N-methoxyethylaniline;
monomethyl-p-phenylenediamine;
2-amino-5-diethylaminotoluene;
N-butyl-N-$\omega$-sulphobutyl-p-phenylenediamine;
2-amino-5-(N-ethyl-N-$\beta$-methanesulphonamide ethylamino)-toluene;
N-ethyl-N-$\beta$-hydroxyethyl-p-phenylenediamine;
N,N-bis-($\beta$-hydroxyethyl)-p-phenylenediamine;
2-amino-5-(N-ethyl-N-$\beta$-hydroxyethylamino)-toluene.

Other colour developers which can be used are described, for example, in J. Amer. Chem. Soc. 73, 3100 (1951).

Conventional silver halide emulsions are suitable for the present invention. As silver halides, these may contain silver chloride, silver bromide, silver iodide or mixtures thereof.

The photographic material produced according to the invention may contain the conventional colour couplers, which are generally present in the silver halide emulsion layers. Thus, the red-sensitive layer contains, for example, a non-diffusing colour coupler for producing the cyan part of the colour image, usually a coupler of the phenol or $\alpha$-naphthol type. The green-sensitive layer contains at least one non-diffusing colour coupler for producing the magenta part of the coloured image for example a colour coupler of the 5-pyrazolone or indazolone type are generally used. Finally, the blue-sensitive layer generally contains at least one non-diffusing colour coupler for producing the yellow part of the colour image, generally a colour coupler with an open-chain ketomethylene group. Colour couplers of these types are known in large numbers and are described in many patent specifications. See for example, the publication "Farbkuppler" by W. Pelz in "Mitteilungen aus den Forschungslaboratorien der Agfa, Leverkusen,-/Munchen" Volume III (1961) and K. Venkataraman in "The Chemistry of Synthetic Dyes" Vol 4, 341, to 387, Academic Press 1971.

2-Equivalent couplers may be used as non-diffusing colour couplers. These couplers contain in the coupling position a substituent which may be eliminated so that they only require two equivalents of silver halide for colour formation, unlike the conventional 4-equivalent couplers. The 2-equivalent couplers which may be used include, for example the known DIR couplers in which the radical which may be eliminated after reaction with colour developer oxidation products, is liberated as a diffusing development inhibitor. Moreover, so-called white couplers may be used to improve the properties of the photographic material.

The non-diffusing colour couplers and colour-giving compounds are added to the casting solutions for the light sensitive silver halide emulsions or other layers by known methods. If water or alkali-soluble compounds are used, they may be added to the emulsions in the form of aqueous solutions, to which water-miscible organic solvents such as ethanol, acetone or dimethyl formamide may be added. If the non-diffusing colour developers and colour-giving compounds are non-water soluble and non-alkali-soluble compounds, they may be emulsified in known manner, for example by mixing a solution of these compounds in a low-boiling organic solvent directly with the silver halide emulsion or firstly with an aqueous gelatine solution whereupon the organic solvent is removed in a conventional manner. A gelatine emulsion of the compound obtained in this way is then mixed with the silver halide emulsion. Additional so-called coupler solvents or oil-formers may be used for emulsifying such hydrophobic compounds. These are generally higher boiling organic compounds containing, in the form of oily droplets the compounds which eliminate the non-diffusing colour couplers and development inhibitors to be emulsified in the silver halide emulsions. Reference is made in this context, for example, to U.S. Pat. Nos. 2,322,027; 2,533,514; 3,689,271; 3,764,336 and 3,765,897.

Gelatine is preferably used as the binder for the photographic layers. However, this may be completely or partially replaced by other natural or synthetic binders. Suitable natural binders include, for example, alginic acid and its derivatives such as its salts, esters or amides; cellulose derivatives such as carboxymethyl cellulose, alkyl celluloses such as hydroxyethyl cellulose; starch or its derivatives such as ethers or esters or caragenates. Suitable synthetic binders include polyvinyl alcohol, partially saponified polyvinyl acetate, polyvinyl pyrrolidone and the like.

The emulsions may also be chemically sensitised for example by addition of sulphur-containing compounds during chemical ripening, for example allyl isothiocyanate; allyl thiourea; sodium thiosulphate and the like. Suitable chemical sensitizers also include reducing agents, for example the tin compounds described in Belgian Patent Nos. 493,464 or 568,687; and polyamines such as diethylene triamine or aminomethyl sulphinic acid derivatives, for example according to Belgian Pat. No. 547,323.

Suitable chemical sensitisers also include precious metals and compounds of precious metals such as gold, platinum, paladium, iridium, ruthenium or rhodium. This method of chemical sensitization is described in the article by R. Koslowsky, Z. Wiss. Phot. 46, 65–72, (1951).

It is also possible to sensitize the emulsions with polyalkylene oxide derivatives, for example with polyethylene oxide having a molecular weight of from 1000 to 20,000, and with condensation products of alkylene oxides and aliphatic alcohols, glycols, cyclic dehydration products of hexitols, with alkyl-substituted phenols, aliphatic carboxylic acids, aliphatic amines, aliphatic diamines and amides. The condensation products have a molecular weight of at least 700, preferably more than 1000. Mixtures of these sensitizers may of course be used to obtain particular effects as described in Belgian Pat. No. 537,278 and British Pat. No. 727,982.

The emulsions may also be sensitised optically, for example with the conventional polymethine dyes, such as neutrocyanine, basic or acidic carbocyanine, rhodacyanines, hemicyanines, styryl dyes and oxonoles. Such sensitizers are described in the book by F. M. Hamer "The Cyanine Dyes and Related Compounds". (1964).

The emulsions may contain, in addition, the conventional stabilizers such as, for example, azaindenes, preferably tetraazaindenes or penta-azaindenes, in particular those which are substituted with hydroxyl or amino groups. Such compounds are described in the article by Birr in Z. Wiss. Phot. 47, (1952), pages 2 to 58. Other suitable stabilizers include heterocyclic mercapto compounds, for example phenyl mercaptotetrazole, quaternary benzothiazole derivatives and benzotriazole.

The emulsions may be hardened in the conventional manner, for example with formaldehyde or halogen-substituted aldehydes containing a carboxyl group such as mucobromic acid, diketones, methane sulphonic acid esters, and dialdehydes.

In addition, the photographic layers may be hardened with epoxy, heterocyclic ethyleneimine or acryloyl hardeners. Examples of such hardeners are described for example, in German Offenlegungsschrift No. 2,263,602 and British Pat. No. 1,266,655. Furthermore, it is also possible to harden the layers by the process described in German Offenlegungsschrift No. 2,218,009 so as to obtain colour photographic materials which are suitable for high temperature processing.

It is also possible to harden photographic layers and the colour photographic multilayer materials with diazine, triazine or 1,2-dihydroquinoline hardeners, as described in British Pat. Nos. 1,193,290; 1,251,091; 1,306,544 and 1,266,655; French Pat. No. 7,102,716 and German Offenlegungsschrift No. 2,332,317. Examples of such hardeners include diazine derivatives containing alkyl or aryl sulphonyl groups; derivatives of hydrated diazines or triazines such as for example, 1,3,5-hexahydrotriazine; fluorine-substituted diazine derivatives such as for example, fluoropyrimidine; esters of 2-substituted 1,2-dihydroquinoline or 1,2-dihydroisoquinoline-N-carboxylic acids. Vinyl sulphonic acid hardeners, carbodiimide or carbamoyl hardeners may also be used, as described, for example, in German Offenlegungsschriften Nos. 2,263,602; 2,225,230 and 1,808,685; French Pat. No. 1,491,807; German Pat. No. 872,153 and German Democratic Republic Pat. No. 7218. Other hardeners which can be used are described, for example, in British Pat. No. 1,268,550.

The compounds to be used according to the invention may be introduced in diffusible or in diffusion-resistant form into at least one layer or intermediate layer of a photographic material either in emulsified or in dispersed or soluble form. They may be added to the light-sensitive silver halide emulsion layers after chemical ripening or to the casting solution, or may be applied together with the last protective coating. The compounds to be used according to the invention may optionally be introduced into the photographic materials by means of a bath prior to first development.

The concentration of the compounds to be used according to the invention in the coatings or in a bath may vary within wide limits. It is adjusted according to the desired effect and to the composition of the photographic material. Quantities of from $10^{-7}$ to $10^{-4}$ mol per square meter have proved suitable for use in a photographic layer. Quantities of between $10^{-6}$ and $10^{-5}$ mol per square meter are preferred.

If the compounds to be used according to the invention are to be introduced into the material by means of a bath prior to first development, optimum concentrations may easily be determined in the bath by a few simple manual tests. Concentrations of from $10^{-6}$ and $10^{-2}$ mol per liter have proved to be sufficient. Concentrations of between $10^{-5}$ and $10^{-3}$ mol per liter of treatment bath are particularly preferred.

The advantageous properties of the compounds to be used according to the invention are particularly surprising in that two effects which are completely opposed to each other may be obtained by means of one chemical substance. These are a stabilizing effect during the first development of photographic reversal materials and a fogging effect during the second development of photographic reversal materials. The compounds, in particular for example, the compounds corresponding to formula (II) can also have a stabilizing effect in conventional colour-negative development.

Another characteristic of the compounds mentioned is their very uniform action on the various emulsion layers which leads to a parallel displacement of the gradations depending upon the concentration of the compounds with equal developing time or allow virtually any adjustment of the first developing period.

The advantage of the stabilizers to be used according to the invention is clarified by the following examples but the invention is not restricted to the embodiments in these examples.

EXAMPLE

The following are applied in succession to a substrate comprising cellulose triacetate with an anti-halation layer of black colloidal silver:

Layer 1: A cyan layer containing a silver bromoiodide emulsion containing 7 mol % of iodide, produced in accordance with Glafkides "Photographic Chemistry", Vol. 1, page 289 ff, Fountain Press, London 1958. The silver content of the emulsion is 100 g per kg of emulsion; expressed as silver nitrate. The emulsion is ripened in known manner by the addition of sulphur compounds and gold-(I)-compounds. It is sensitised to the red spectral range and contains a colour coupler corresponding to the following formula:

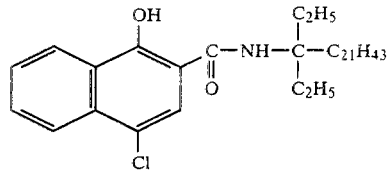

Layer 2: A second cyan layer containing a silver bromoiodide emulsion containing 6 mol % of iodide, produced by the process described under layer 1 but more sensitive. The layer contains the same colour coupler as layer 1.

Layer 3: A magenta layer containing a silver bromoiodide emulsion as described under layer 1, but sensitized to the green spectral range. It contains a coupler corresponding to the following formula:

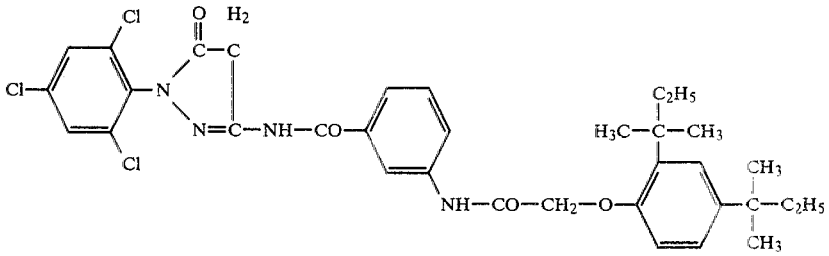

Layer 4: A second magenta layer containing an emulsion as described under layer 2 but sensitized to the green spectral range and with the same coupler as layer 3.

Layer 5: A yellow filter layer composed of a silver sol.

Layer 6: A yellow layer containing a silver bromoiodide emulsion containing 4 mol % of iodide prepared as described under layer 1 which is sensitive to the blue spectral range. The coating contains a coupler corresponding to the following formula:

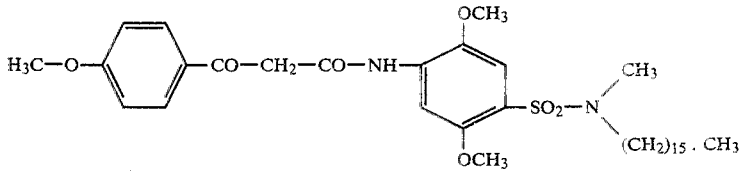

Layer 7: A second yellow layer, containing a silver bromoiodide emulsion containing 6 mol % of iodide prepared as described under layer 1 and with a higher sensitivity in the blue spectral range than layer 6. The layer contains the same colour coupler as layer 6.

Layer 8: The multilayer material is sealed off with a protective layer. The casting solution used for this purpose contains 1.6% of gelatin in addition to the hardening and wetting agent. The application corresponds to 50 ml per square meters.

The casting solution for layer 8 is varied as follows (quantity per liter of casting solution):

A: Casting solution without other additives

B: Casting solution with 100 mg of comparison substance

C: Casting solution with 100 mg of compound II

D: Casting solution with 100 mg of compound V

E: Casting solution with 200 mg of compound II

F: Casting solution with 60 mg of compound III

The known stabiliser 1-phenyl-5-mercapto tetrazole is used as the comparison substance.

The materials are exposed imagewise in conventional manner and are subjected to reversal processing with the following baths:

PROCESSING I

The photographic material is developed for eight minutes at 30° C. in the following first developer I. The photographic material is subsequently subjected to a stop bath, rinsed, exposed for the second time and developed for six minutes in developer II. After the second development, it is stopped, washed, bleached and fixed, rinsed and dried in the usual manner.

| | |
|---|---|
| Developer I (Concentration per liter) | |
| Ethylenediaminetetra-acetic acid | 2 g |
| Soda sicc. | 27.5 g |
| Sodium sulphite sicc | 50 g |
| 1-phenyl-3-pyrazolidone | 0.3 g |
| Hydroquinone | 6 g |
| Potassium rhodanide, 50% aqueous solution | 5 ml |
| Potassium bromide | 2 g |
| Sodium hydrogen carbonate | 6 g |
| Potassium iodide, 0.1% aqueous solution | 15 ml |
| pH-Value: 10.0 | |
| Developer II (Concentration per liter) | |
| Ethylenediaminetetra-acetic acid | 2 g |
| Disodium salt of 1-hydroxy-ethane-1.1-diphosphonic acid | 2 g |
| Trisodium phosphate sicc | 60 g |
| Sodium sulphite | 5 g |
| 4-amino-3-methyl-N-ethyl-N-(β-hydroxy-ethyl)-aniline | 5 g |
| Potassium Bromide | 2 g |
| Sodium hydroxide | 2.4 g |
| Hydroxylaminsulfate | 1 g |
| Poly-1-(2-hydroxyethylmercapto)-propylenoxide* | 500 mg |
| pH-Value 12.1 | |

*Molecular weight: about 2912

PROCESSING II

The processing I is carried out with the following alterations:

The second exposure is omitted and instead, the material is treated for two minutes with an aqueous bath which contains only 30 g of sodium hydroxide per liter. The following maximum densities are obtained:

| | Processing | | | | | |
|---|---|---|---|---|---|---|
| | I $D_{max}$ | | | II $D_{max}$ | | |
| Sample | yellow | magenta | cyan | yellow | magenta | cyan |
| A | 2.71 | 3.09 | 2.82 | 1.91 | 1.65 | 2.02 |
| B | 3.11 | 3.49 | 2.92 | 1.96 | 1.51 | 1.86 |
| C | 3.12 | 3.40 | 2.93 | 2.64 | 2.73 | 2.80 |
| D | 3.12 | 3.39 | 2.90 | 3.05 | 3.29 | 2.84 |
| E | 3.24 | 3.47 | 2.99 | 3.09 | 3.26 | 3.03 |
| F | 3.08 | 3.27 | 2.87 | 3.15 | 3.06 | 3.00 |

Whereas known stabilizers hinder the formation of dyes in the second development, the formation of dyes is promoted by the substances used according to the invention, so that second exposure may be dispensed with.

We claim:

1. In a photographic reversal process for the production of positive photographic images by imagewise exposure of photographic material which contains at least one silver halide emulsion layer,
   first development of said exposed material in a first developer and,
   stabilization of the silver halide in said emulsion against fog, and
   subsequent treatment of said first developed material including,
   a second development of the photographic material to form a positive reversal photographic image in the material,
   the improvement according to which the photographic material contains during said first development in a stabilizing amount at least one compound of the following formula:

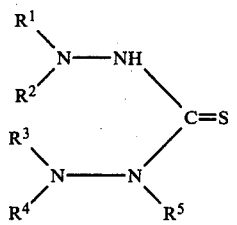

in which
   $R^1$ and $R^4$ which may be the same or different, represent hydrogen, a saturated or olefinically unsaturated aliphatic group, an aryl group, a heterocyclic group or an acyl group;
   $R^2$ and $R^3$ which may be the same or different, represent hydrogen, a saturated or olefinically unsaturated aliphatic group, an aryl group or a heterocyclic group;
   $R^5$ represents hydrogen, and/or
   $R^1$ together with $R^2$ and/or
   $R^3$ together with $R^4$ represent a methylidene group which may be substituted by an alkyl, aryl, heterocyclic group or an acyl group selected from the group consisting of acetyl, benzoyl, phenyl, sulphonyl, carbamoyl, phenyl carbamoyl, ethoxycarbonyl, and ethoxythiocarbonyl, wherein two such substituents together with the carbon atom of the methylidene group can complete a carbocyclic or heterocyclic ring so that said stabilizer inhibits fogging in said first development.

2. The process of claim 1 wherein $R^1$ and/or $R^4$ represents, in the compound used, an acyl group which is derived from aliphatic or aromatic carboxylic or sulphonic acids including carbonic mono esters; thiocarbonic monoesters, carbamic acids and sulphamic acids.

3. The process of claim 1 wherein $R^1$ together with $R^2$ and/or $R^3$ together with $R^4$ represent, a methylidene group in the compound used, which is part of a cyclopentane, cyclohexane, indane, indanone, indanedione, piperidine, pyrrolidone or indolone ring.

4. The process of claim 1 wherein $R^2$, $R^3$ and $R^5$ represent hydrogen.

* * * * *